US009215536B2

(12) United States Patent
Lu

(10) Patent No.: US 9,215,536 B2
(45) Date of Patent: Dec. 15, 2015

(54) EARPHONE DEVICE HAVING INTEGRATED ANTENNA

(71) Applicant: DEXIN CORPORATION, New Taipei (TW)

(72) Inventor: Ho-Lung Lu, New Taipei (TW)

(73) Assignee: DEXIN CORPORATION, New Taipei (TW)

( * ) Notice: Subject to any disclaimer, the term of this patent is extended or adjusted under 35 U.S.C. 154(b) by 505 days.

(21) Appl. No.: 13/663,582

(22) Filed: Oct. 30, 2012

(65) Prior Publication Data

US 2014/0119555 A1 May 1, 2014

(51) Int. Cl.
*H04R 1/10* (2006.01)
*H04R 25/00* (2006.01)

(52) U.S. Cl.
CPC ..... *H04R 25/554* (2013.01); *H04R 1/1033* (2013.01); *H04R 2225/51* (2013.01)

(58) Field of Classification Search
CPC ..... H04R 5/033; H04R 5/04; H04R 2420/07; H04R 1/1041; H04R 1/1016
See application file for complete search history.

(56) References Cited

U.S. PATENT DOCUMENTS

2007/0032130 A1* 2/2007 Yoshino ..... H05K 1/0218 439/578
2007/0249312 A1* 10/2007 Shatara ..... H04B 7/0814 455/272
2007/0257854 A1* 11/2007 Guo ..... H01Q 9/30 343/790

* cited by examiner

*Primary Examiner* — Simon Sing
(74) *Attorney, Agent, or Firm* — Li & Cai Intellectual Property (USA) Office

(57) ABSTRACT

An earphone device having an integrated antenna, comprising a coaxial cable, a receiver and a signal processing module. The coaxial cable includes a first end and a second end. The receiver includes an antenna module and a speaker module, where the antenna module and the speaker module are in connection and are electrically connected to the first end of the coaxial cable. The signal processing module includes a baseband unit and a radio frequency unit, where the baseband unit and the radio frequency unit are in connection and are electrically connected to the second end of the coaxial cable. Thus, the earphone device having an integrated antenna of the instant disclosure can reduce the surface area of the main board effectively to enhance the efficiency of the antenna.

9 Claims, 7 Drawing Sheets

EARPHONE DEVICE HAVING INTEGRATED ANTENNA

BACKGROUND OF THE INSTANT DISCLOSURE

1. Field of the Instant Disclosure

The instant disclosure relates to an earphone device; in particular, to an earphone device having an integrated antenna.

2. Description of Related Art

In present day, consumer electronic products such as mobile phones, notebook computer and etc. are usually equipped with a wireless transmission function such as Bluetooth for users to listen to music or communicate more conveniently through a Bluetooth wireless earphone. Nevertheless, the antenna of a conventional Bluetooth wireless earphone is usually a coaxial cable or a chip antenna arranged on the main board of the earphone for wireless transmission. Thus, utilizing a coaxial cable described in the prior design is prone to reduce the efficiency of the antenna, where the later design may increases the surface area of the main board which in turn reduces the efficiency of the antenna.

Therefore, it is a critical issue for those who are skilled in the field to find a solution to enhance the efficiency of the antenna and reduce the surface area of the main board of the wireless earphone.

SUMMARY OF THE INSTANT DISCLOSURE

The object of the instant disclosure is to provide an earphone device having integrated antenna, where a chip antenna of the instant disclosure can be placed within the user's ear to reduce the surface area of the main board so as to enhance the efficiency of the antenna.

An embodiment of the instant disclosure provides an earphone device having an integrated antenna, comprising a coaxial cable, a receiver, and a signal processing module. The coaxial cable includes a first end and a second end. The receiver includes an antenna module and a speaker module, where the antenna module and the speaker module are in connection and are electrically connected to the first end of the coaxial cable. The signal processing module includes a baseband unit and a radio frequency unit, where the baseband unit and the radio frequency unit are in connection and are electrically connected to the second end of the coaxial cable.

Another embodiment of the instant disclosure provides an earphone device having an integrated antenna, comprising a first coaxial cable, a second coaxial cable, a receiver unit and a signal processing module. The first coaxial cable includes a first end and a second end; similarly, the second coaxial cable includes a first end and a second end. The receiver unit includes a first receiver and a second receiver. The first receiver includes an antenna module and a speaker module, where the antenna module and the speaker module are in connection and are electrically connected to the first end of the first coaxial cable. The second receiver includes a speaker module connected electrically to the first end of the second coaxial cable. The signal processing module includes a baseband unit and a radio frequency unit, where the baseband unit and the radio frequency unit are in connection and are electrically connected to the second end of the first coaxial cable and the second end of the second coaxial cable.

Based on the above, the instant disclosure provides an earphone device having an integrated antenna, where the earphone device can reduce the surface area of the main board effectively so as to enhance the efficiency of the antenna through "the antenna module and the speaker module are in connection and are electrically connected to the first end of the coaxial cable", and "the baseband unit and the radio frequency unit are in connection and are electrically connected to the second end of the coaxial cable".

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

The First Embodiment

Figure 1:
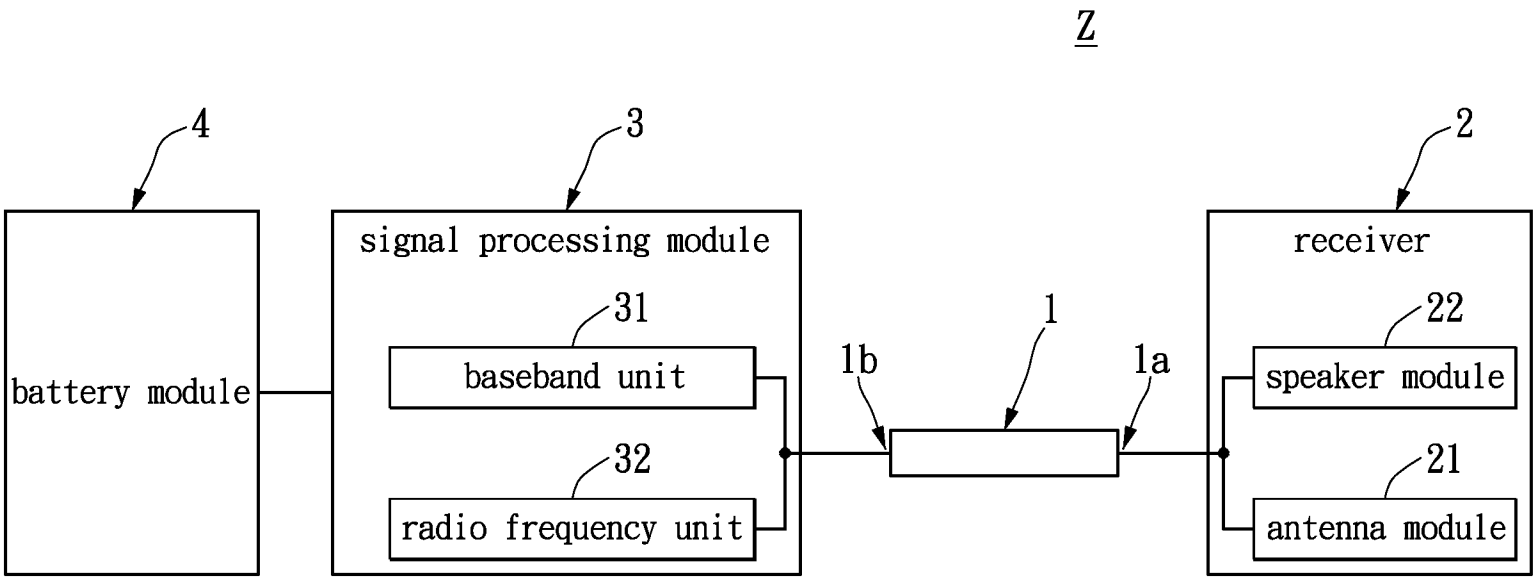
FIG. 1 shows a block diagram of an earphone device integrated with an antenna according to a first embodiment of the instant disclosure.
Figure 2:
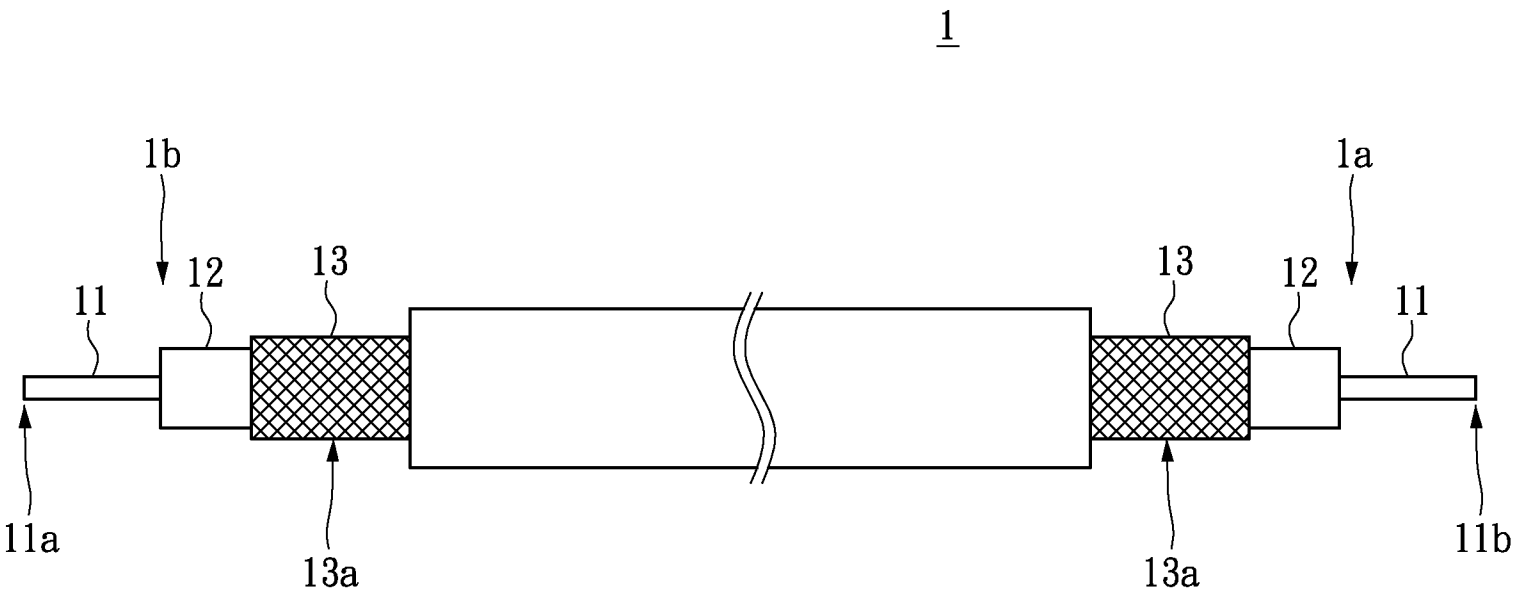
FIG. 2 shows a perspective view of a coaxial cable of the earphone device integrated with an antenna according to the first embodiment of the instant disclosure.
Figure 3:
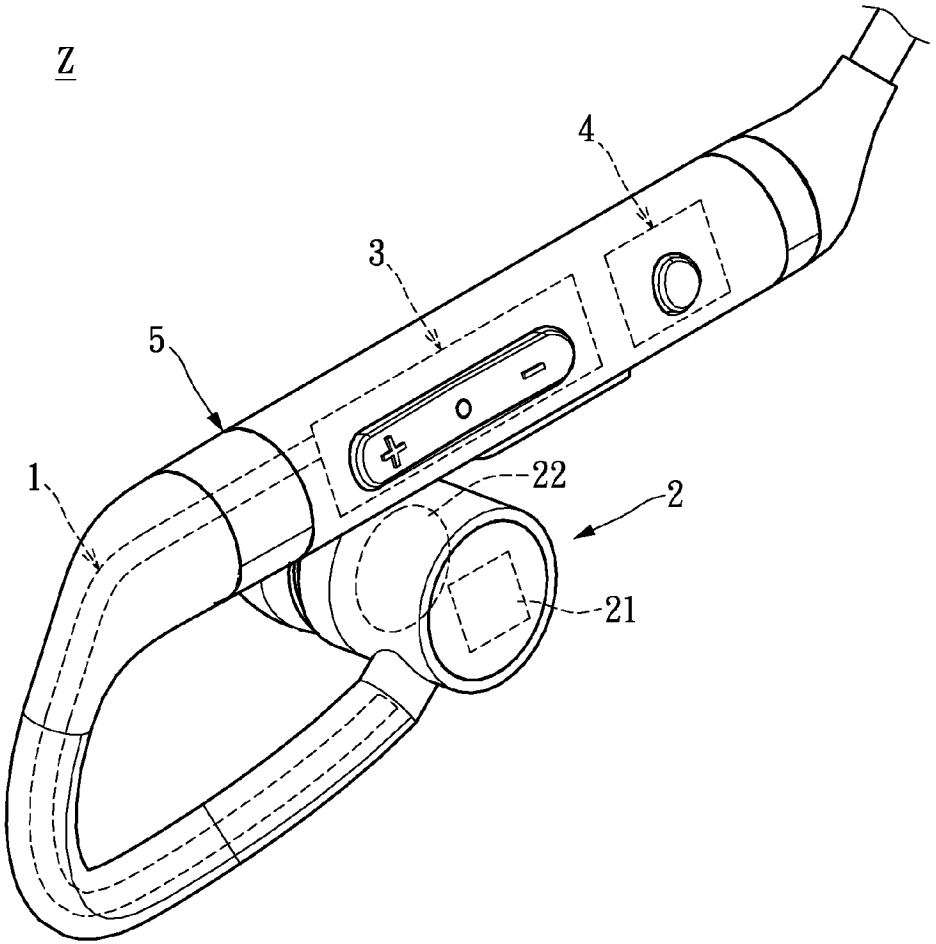
FIG. 3 shows a three-dimensional perspective view of the earphone device integrated with an antenna according to the first embodiment of the instant disclosure.

Please refer to FIGS. 1 to 3. According to the aforementioned figures, the instant embodiment provides an earphone device having an integrated antenna Z, comprising a coaxial cable 1, a receiver 2 and a signal processing module 3. Practically, the receiver 2 can be an earplug receiver. During utilization, the receiver 2 can be inserted into the user's ear for listening.

Shown in FIG. 1, the coaxial cable 1 has a first end 1*a* and a second end 1*b*. The receiver 2 includes an antenna module 21 and a speaker module 22, where the antenna module 21 and the speaker module 22 are in connection and are electrically connected to the first end 1*a* of the coaxial cable 1. To provide further explanations, as the speaker module 22 is placed proximate to the user's ear (not shown), where the antenna module 21 is placed away from the user's ear, where the antenna module is placed away from the user's ear and a predetermined distance (not shown) is kept from the receiver 2. Therefore, the antenna module 21 will not be easily influenced by the surrounding objects (such as the user's face) which may reduce the efficiency of the antenna. Hence, the earphone device having an integrated antenna Z of the instant disclosure can reduce the surface area of the main board effectively and enhance the efficiency of the antenna. Practically, the antenna module 21 can be a chip antenna such as a ceramic chip antenna having an operating frequency section of 2.4 GHz, where the speaker module 22 can be an amplifier such as a speaker to pronounce sound.

The signal processing module 3 includes a baseband unit 3131 and a radio frequency unit 32, where the baseband unit 3131 and the radio frequency unit 32 are in connection and are connected electrically to the second end 1*b* of the baseband unit 3131. To provide further explanations, the baseband signal of the baseband unit 3131 and the radio frequency signal of the radio frequency unit 32 are mixed together by the signal processing module 3 (main board) of the coaxial cable 1 to transmit and receive signals. Therefore, no additional base plate is required (mix circuit and filter circuit) to mix the radio frequency signal and the baseband signal. Furthermore, the baseband signal can utilize the differential signal during transmission, and thereby, no additional base plate is required to reduce noise. Practically, the aforementioned baseband unit 31 can be a chip utilized to process low frequency signals (such as sound signals having frequency lower than 20 KHz), where the radio frequency unit 32 can be a chip utilized to process high frequency signals (such as a working frequency section of 2.4 GHz).

Shown in FIG. 2, the coaxial cable 1 includes a central rod 11, an insulative portion 12 sheathing the central rod 11, and an outer conductive portion 13 sheathing the insulative portion 12. The two ends of the central rod 11 are formed with a feed-in end 11*a* and a signal end 11*b*, and the outer conductive portion 13 has a ground end 13*a*. To provide further explanations, the feed-in end 11*a* of the central rod 11 is arranged proximate to the signal processing module 3, and the signal end 11*b* of the central rod 11 is arranged proximate to the receiver 2. Furthermore, the central rod 11 is utilized to transmit baseband signal and radio frequency signal. The outer conductive portion 13 can be a reference ground for the baseband signal and the radio frequency signal. Practically, the coaxial cable 1 can be a coaxial wire Please refer to FIG. 1, the earphone device having an integrated antenna Z of the instant disclosure further includes a battery module 4 electrically connected to the signal processing module 3. Practically, the battery module 4 can utilize a rechargeable battery as a power saving device to provide electricity to the signal processing module 3.

Please refer to FIG. 3, the earphone device having an integrated antenna Z of the instant disclosure further includes a housing 5, where the coaxial cable 1, the receiver 2, the signal processing module 3 and the battery module 4 can be received within the housing 5. It is worth noting that the components accommodated within the housing 5 can be adjusted or switched according to practical needs.

The Second Embodiment

Please refer to FIGS. 4 to 7. The second embodiment of the instant disclosure provides an earphone device having an integrated antenna Z, comprising a first coaxial cable 8, a second coaxial cable 9, a receiver unit (which comprises a pair of receivers 2*a/b*), and a signal processing module 3.

Figure 4:
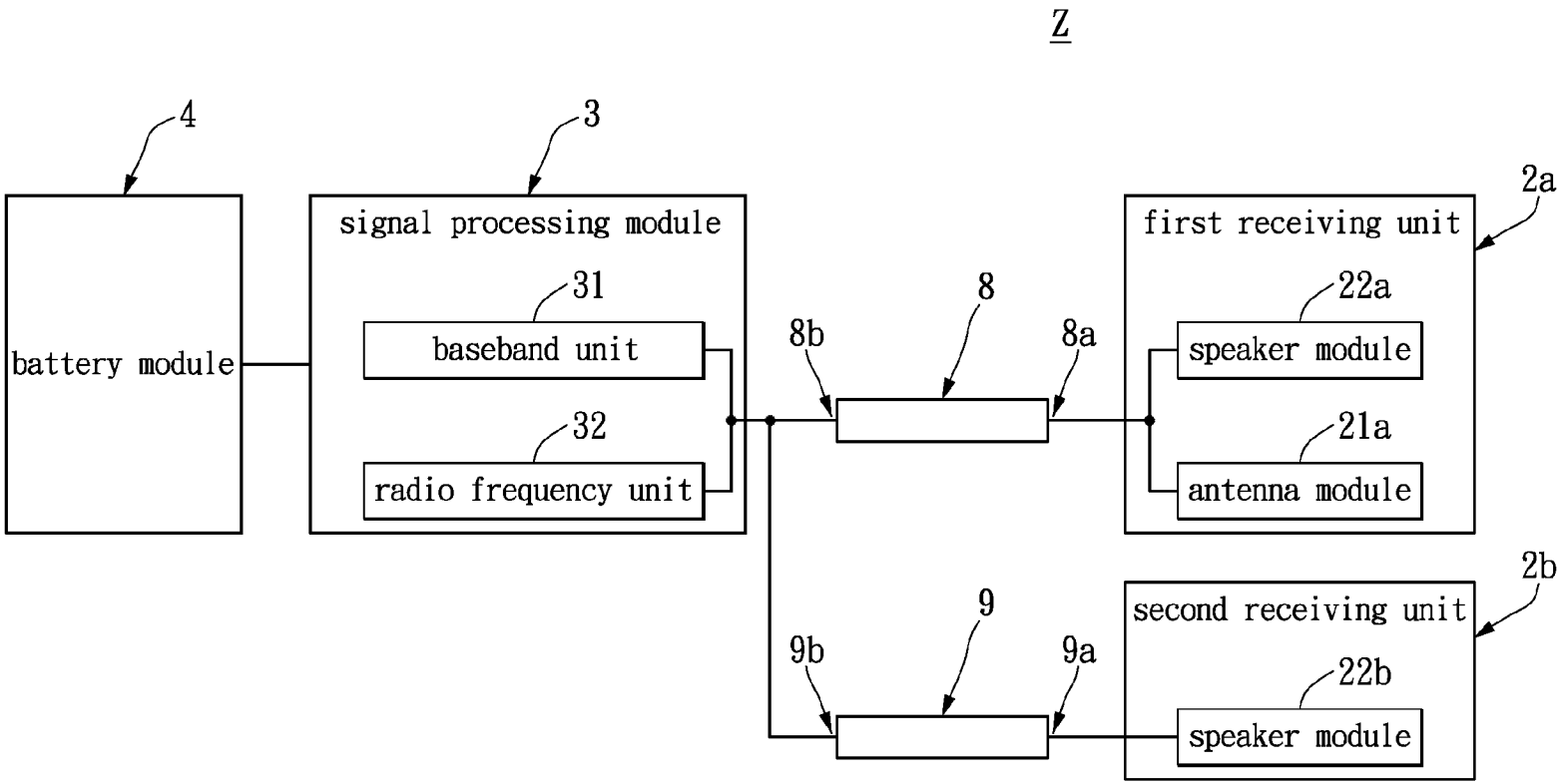
FIG. 4 shows a block diagram of the earphone device integrated with an antenna according to a second embodiment of the instant disclosure.

By comparing FIG. 4 to FIG. 1, the difference between the second embodiment and the prior embodiment is that the first coaxial cable 8 of the second embodiment includes a first end 8*a* and a second end 8*b*, and the second coaxial cable 9 includes a first end 9*a* and a second end 9*b*. Furthermore, the receiver unit includes a first receiver 2*a* and a second receiver 2*b*, where the first receiver 2*a* includes an antenna module 21*a* and a speaker module 22*a*, while the antenna module 21*a* and the speaker module 22*a* are structurally and electrically connected at the first end 8*a* of the first coaxial cable 8. The second receiver 2*b* includes a speaker module 22*b* connected electrically to the first end 9*a* of the second coaxial cable 9. The signal processing module 3 includes a baseband unit 31 and a radio frequency unit 32, where the baseband unit 31 and the radio frequency unit 32 are in connection and are electrically connected to the second end 8*b* of the first coaxial cable 8 and the second end 9*b* of the second coaxial cable 9.

Figure 5:
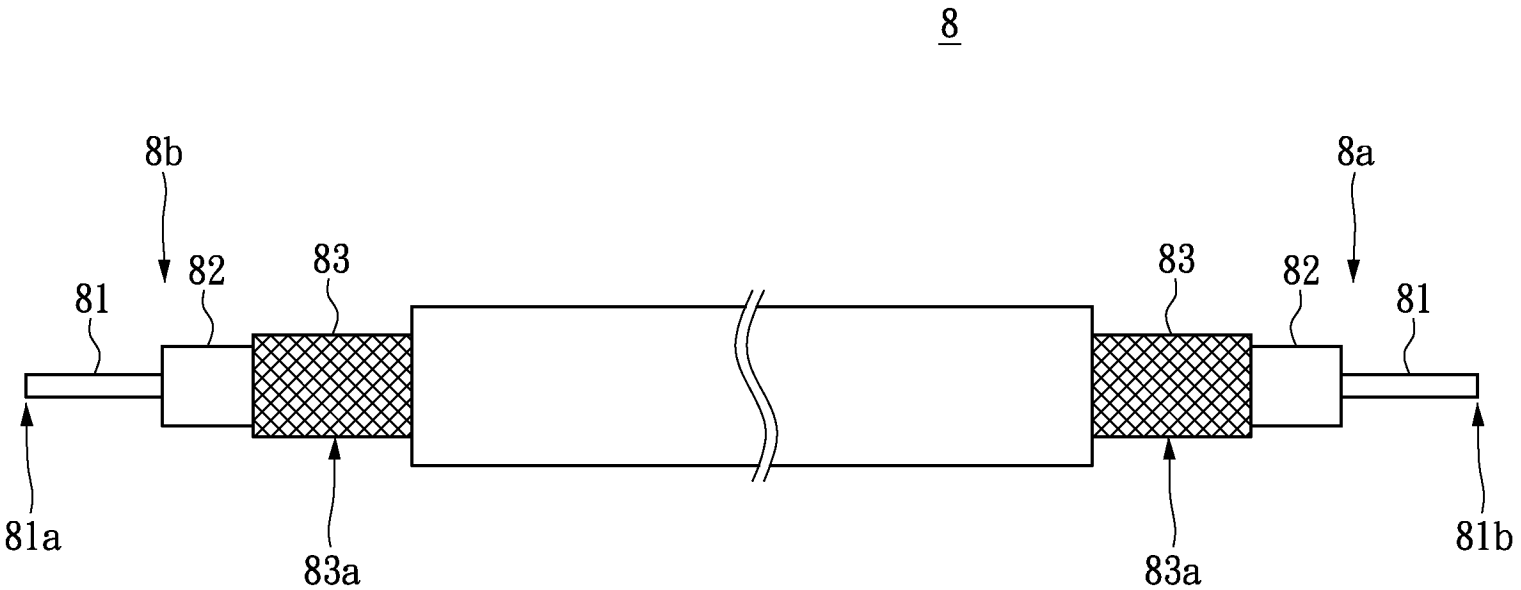
FIG. 5 shows a perspective view of a first coaxial cable of the earphone device integrated with an antenna according to the second embodiment of the instant disclosure.
Figure 6:
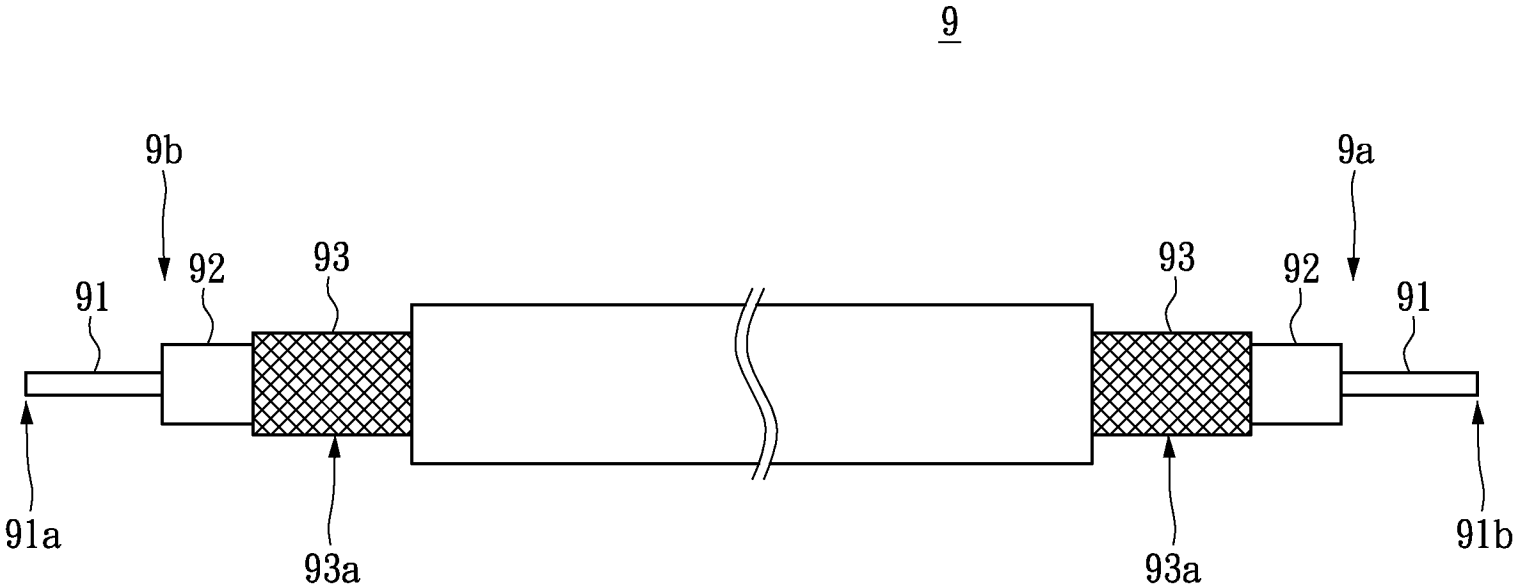
FIG. 6 shows a perspective view of a second coaxial cable of the earphone device integrated with an antenna according to the second embodiment of the instant disclosure.
Figure 7:
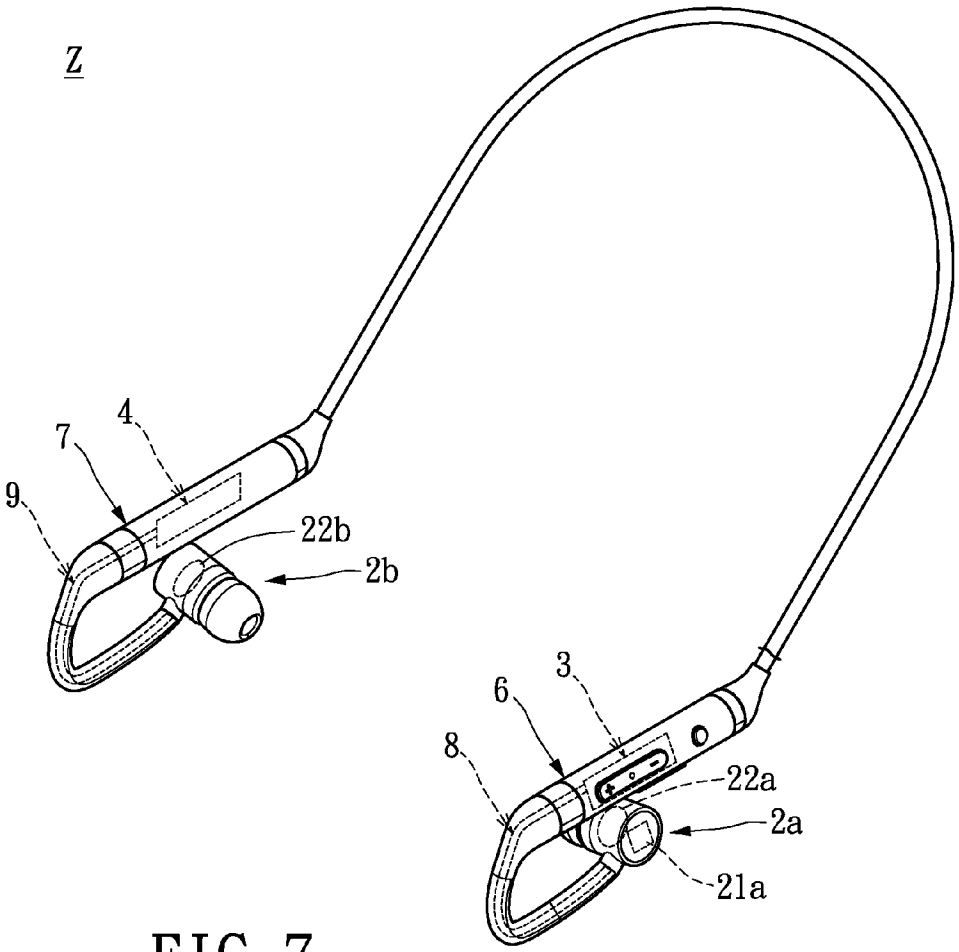
FIG. 7 shows a three-dimensional perspective view of the earphone device integrated with an antenna according to the second embodiment of the instant disclosure.

Shown in FIG. 5, the first coaxial cable 8 includes a central rod 81, an insulative portion 82 sheathing the central rod 81, and an outer conductive portion 83 sheathing the insulative portion 82. The two sides of the central rod 81 are formed with a feed-in end 81*a* and a signal end 81*b*, where the outer conductive portion 83 has a ground end 83*a*. Shown in FIG. 6, the second coaxial cable 9 includes a central rod 91, an insulative portion 92 sheathing the central rod 91 and an outer conductive portion 93 sheathing the insulative portion 92. The two sides of the central rod 91 are formed with a feed-in end 91*a* and a signal end 91*b*, where the outer conductive portion 93 has a ground end 93*a*.

Shown in FIG. 4, the earphone device having an integrated antenna Z of the instant disclosure further includes a battery module 4 connected electrically to the signal processing module 3. Shown in FIG. 7, the earphone device having an integrated antenna Z of the instant disclosure further includes a first housing member 6 and a second housing member 7, where the first coaxial cable 8, the first receiver 2*a*, and the signal processing module 3 can be accommodated within the first housing member 6, and where the second coaxial cable 9, the second receiver 2*b*, and the battery module 4 can be accommodated within the second housing member 7. Furthermore, the first receiver 2*a* can be placed within the user's left ear, while the second receiver 2*b* can be placed within the user's right ear while in use. Thus, the instant disclosure can provide users with a stereophonic effect. It is worth noting that the components accommodated within the first housing member 6 and the second housing member 7 can be adjusted or switched due to practical needs.

[Possible Effects of the Instant Disclosure]

Based on the above, the instant disclosure provides an earphone device having an integrated antenna, where the earphone device can reduce the surface area of the main board effectively so as to enhance the efficiency of the antenna through "the antenna module and the speaker module are in connection and are electrically connected to the first end of the coaxial cable", and "the baseband unit and the radio frequency unit are in connection and are electrically connected to the second end of the coaxial cable".

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An earphone device having an integrated antenna, comprising:

a coaxial cable having a first end and a second end;

an earplug receiver including an antenna module and a speaker module, wherein the antenna module is used for high frequency operation, and the speaker module is used for sound pronunciation, and wherein the antenna module and the speaker module are structurally and electrically arranged at the first end of the coaxial cable;

a signal processing module including a baseband unit and a radio frequency unit, wherein the baseband unit is used to process sound signals, and the radio frequency unit is used to process high frequency signals, and wherein the baseband unit and the radio frequency unit are structurally and electrically arranged at the second end of the coaxial cable such that the coaxial cable is utilized to transmit the sound signals and the high frequency signals to the first end of the coaxial cable.

2. The earphone device having an integrated antenna according to claim 1, wherein the coaxial cable includes a central rod, an insulative portion sheathing the central rod, and an outer conductive portion sheathing the insulative portion, wherein the central rod has a feed-in end and a signal end formed on the two ends thereof, and wherein the outer conducive portion has a ground end.

3. The earphone device having an integrated antenna according to claim 1, further comprising a battery module electrically connected to the signal processing module.

4. The earphone device having an integrated antenna according to claim 3, further comprising a housing, wherein the coaxial cable, the receiver, the signal processing module, and the battery module are received in the housing.

5. An earphone device having an integrated antenna, comprising:

a first coaxial cable having a first end and a second end;

a second coaxial cable having a first end and a second end;

an earplug receiver unit including a first receiver and a second receiver, wherein the first receiver includes an antenna module and a first speaker module, wherein the antenna module is used for high frequency operation, and the first speaker module is used for sound pronunciation, wherein the antenna module and the speaker module are in connection and are electrically connected to the first end of the first coaxial cable, wherein the second receiver includes a second speaker module, wherein the second speaker module is used for sound pronunciation, and wherein the second speaker module is electrically connected to the first end of the second coaxial cable; and a signal processing module including a baseband unit and a radio frequency unit, wherein the baseband unit is used to process sound signals, and the radio frequency unit is used to process high frequency signals, and wherein the baseband unit and the radio frequency unit are in connection and are electrically connected to the second end of the first coaxial cable, and the second end of the second coaxial cable such that the first and second coaxial cables are utilized to transmit the sound signals and the high frequency signals to the first end of the first coaxial cable, and the first end of the second coaxial cable.

6. The earphone device having an integrated antenna according to claim 5, wherein the first coaxial cable includes a central rod, an insulative portion sheathing the central rod and an outer conductive portion sheathing the insulative portion, wherein the central rod has a feed-in end and a signal end formed on the two ends thereof, and wherein the outer conducive portion has a ground end; the second coaxial cable includes a central rod, an insulative portion sheathing the central rod, and an outer conductive portion sheathing the insulative portion, wherein the central rod has a feed-in end and a signal end formed on the two ends thereof, and wherein the outer conductive portion has a ground end.

7. The earphone device having an integrated antenna according to claim 5, further comprising a battery module electrically connected to the signal processing module.

8. The earphone device having integrated antenna according to claim 5, further comprising a first housing member, wherein the first coaxial cable, the first receiver, and the signal processing module are received in the first housing member.

9. The earphone device having integrated antenna according to claim 7, further comprising a second housing member, wherein the second coaxial cable, the second receiver, and the battery module are received in the second housing member.

* * * * *